US005506762A

United States Patent [19]

Ziegler et al.

[11] Patent Number: 5,506,762

[45] Date of Patent: Apr. 9, 1996

[54] FLUID-FILLED COLORED LIGHT PATTERN GENERATOR WITH TWIST CAP

[75] Inventors: Byron J. Ziegler; Steven T. Mahanay, both of Austin, Tex.

[73] Assignee: High End Systems, Inc., Austin, Tex.

[21] Appl. No.: 295,398

[22] Filed: Aug. 25, 1994

[51] Int. Cl.[6] ..... F21V 3/00; F21V 9/00

[52] U.S. Cl. ..... 362/273; 362/318; 362/311; 362/806; 362/323; 359/665; 359/666

[58] Field of Search ..... 362/318, 293, 362/202, 311, 811, 806, 101, 96, 294, 277, 280, 282, 323, 322, 319; 359/665, 666

[56] References Cited

U.S. PATENT DOCUMENTS

| | | | |
|---|---|---|---|
| 504,890 | 9/1893 | Ohmart | 359/666 |
| 1,203,464 | 8/1970 | Dawe . | |
| 1,246,566 | 9/1971 | Doody . | |
| 1,536,328 | 12/1978 | Doody . | |
| 2,334,766 | 11/1943 | Hermann | 362/205 X |
| 3,121,169 | 2/1964 | Benton | 359/665 X |
| 4,170,035 | 10/1979 | Walker | 362/806 X |
| 4,388,678 | 6/1983 | Turner | 362/293 |
| 4,742,439 | 5/1988 | Choate | 362/811 X |

FOREIGN PATENT DOCUMENTS

| | | | |
|---|---|---|---|
| 0518096 | 3/1955 | Italy | 359/666 |
| 0758668 | 10/1956 | United Kingdom | 359/666 |

*Primary Examiner*—James C. Yeung
*Assistant Examiner*—Thomas M. Sember
*Attorney, Agent, or Firm*—James R. Bell

[57] ABSTRACT

A colored light pattern generator including a pair of transparent plates maintained in spaced relationship in a sealed container for defining a fluid-filled cavity. The container includes a receiver and a twist-on-and-off cap ring. The fluid produces random, floating colored images in response to a beam of light being passed through the plates.

9 Claims, 2 Drawing Sheets

FLUID-FILLED COLORED LIGHT PATTERN GENERATOR WITH TWIST CAP

FIELD OF THE INVENTION

This invention relates generally to stage and theater lighting and specifically to projecting light produced images by passing a beam of light through a fluid filled colored light pattern generator or gobo including a cavity having colored image producing members suspended in the fluid.

BACKGROUND OF THE INVENTION

One commonly used gobo comprises a sheet of metal having a desired image cut out of the sheet. When the sheet is placed in a beam of light, the portion of the beam that passes through the sheet is shaped to correspond to the image.

Another commonly used gobo for creating artistic lighting effects comprises a metal coated glass disc with a portion of the coating etched in the shape of an image. When the disc is placed in a beam of light, the portion of the beam that passes through the disc is shaped to correspond to the image.

In the past, oils of various colors and viscosities were also used to create artistic colored lighting effects when a beam of light was passed through a plate or disc which contained the oil. For example, it is known that some hot oil projection was accomplished through the combination of an overhead projector and oils of various colors and viscosities contained in a transparent plate which when moved, caused the moving colored oils to translate to projected moving color patterns.

Also, it is known that a transparent disc having a plurality of segregated cavities therein, which contained various colored oils, was inserted into the path of a light beam and rotated to create animated, artistic colored lighting effects.

A major consideration of using such oils is that the oils must not be overheated by the light beam. Today's lights are of high watt density and high energy. Therefore, the oil selected must be low absorbing with regard to the energy passed though it, i.e. it must have a high operating temperature, so that it can survive with a high amount of energy passing through it via the light beam.

The foregoing illustrates limitations of the known prior art. Thus, it is apparent that it would be advantageous to provide an alternative directed to overcoming one or more of the limitations as set forth above. Accordingly, a suitable alternative is provided including features and benefits more fully disclosed hereinafter.

SUMMARY OF THE INVENTION

In one aspect of the present invention, this is accomplished by providing a colored light pattern generator comprising a pair of transparent plates maintained in spaced relationship in a sealed container including a cavity formed between the plates. The container includes a first receiver ring and a second cap ring which are engaged by relative rotational motion. Seal means provide a fluid-tight seal so that the cavity can retain fluid. Means are provided in the cavity for producing projected colored images in response to a beam of light being passed through the transparent plates.

In another aspect of the present invention, this is accomplished by a colored light pattern generator comprising a receiver ring, a pair of transparent plates maintained in spaced relationship in the receiver ring and having a cavity formed between the plates, a cap ring rotatably engaged with the receiver ring so that the rings form a container and the plates are maintained in the container, and means for fluidly sealing the cavity within the container.

In a further aspect of the present invention, this is accomplished by a colored light pattern generator including a pair of transparent plates maintained in spaced relationship in a container so as to define a cavity between the plates. The container includes a receiver ring rotatably engaged with a cap ring. Means are provided for fluidly sealing the cavity.

In a still further aspect of the invention, this is accomplished by a colored light pattern generator image projection system comprising a container having transparent walls and being movably mounted in the path of a light beam. The container defines a fluid cavity therein. An optically clear fluid is sealed in the cavity and a plurality of various color producing, shaped solid translucent particles are suspended for random movement in the fluid. The container is formed by a retainer ring rotatably engaged with a cap ring and the transparent walls are retained by the rings so that when the light beam is passed through the container and the container is moved, various moving colored images are projected by the beam onto a projection surface in response to the particles interfering with passage of the beam through the container.

The foregoing and other aspects will become apparent from the following detailed description of the invention when considered in conjunction with the accompanying drawing figures. It is to be expressly understood, however, that the figures are not intended as a definition of the invention, but are for the purpose of illustration only.

BRIEF DESCRIPTION OF THE DRAWING FIGURES

DETAILED DESCRIPTION OF THE INVENTION

In stage and theater lighting, it is well known to mount a gobo in a movable gobo holder so that when a light beam is passed through the gobo, an image is projected on a projection surface.

Figure 3:
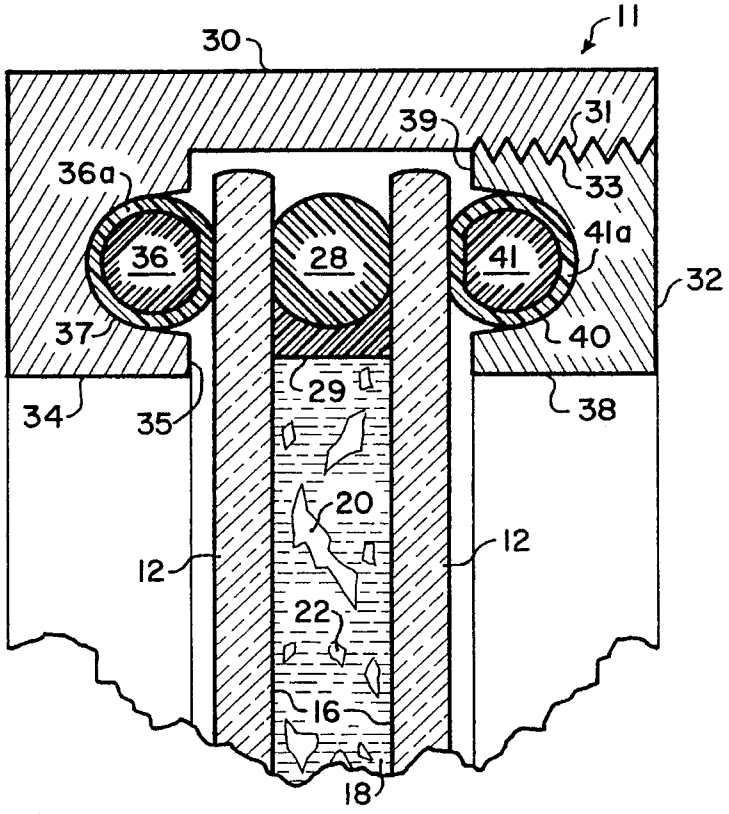
FIG. 3 is an enlarged partial cross-sectional view taken along the line 3—3 of FIG. 1.
Figure 1:
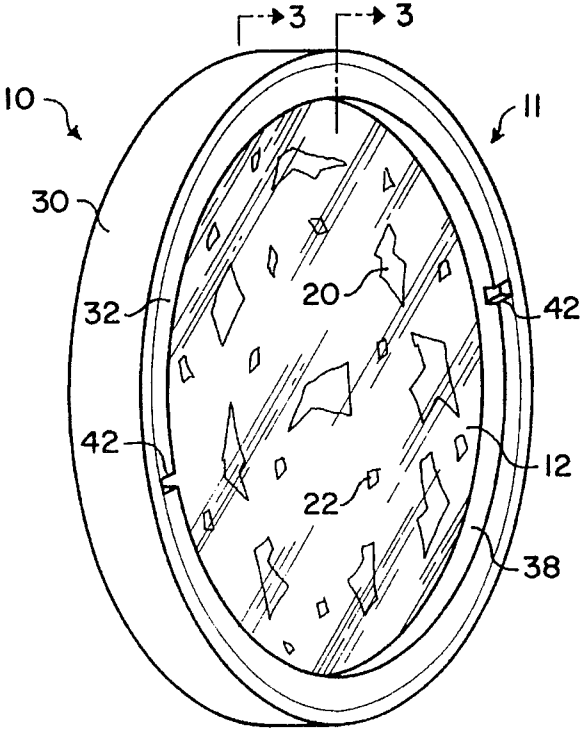
FIG. 1 is a perspective view illustrating an embodiment of the gobo of the present invention.
Figure 2:
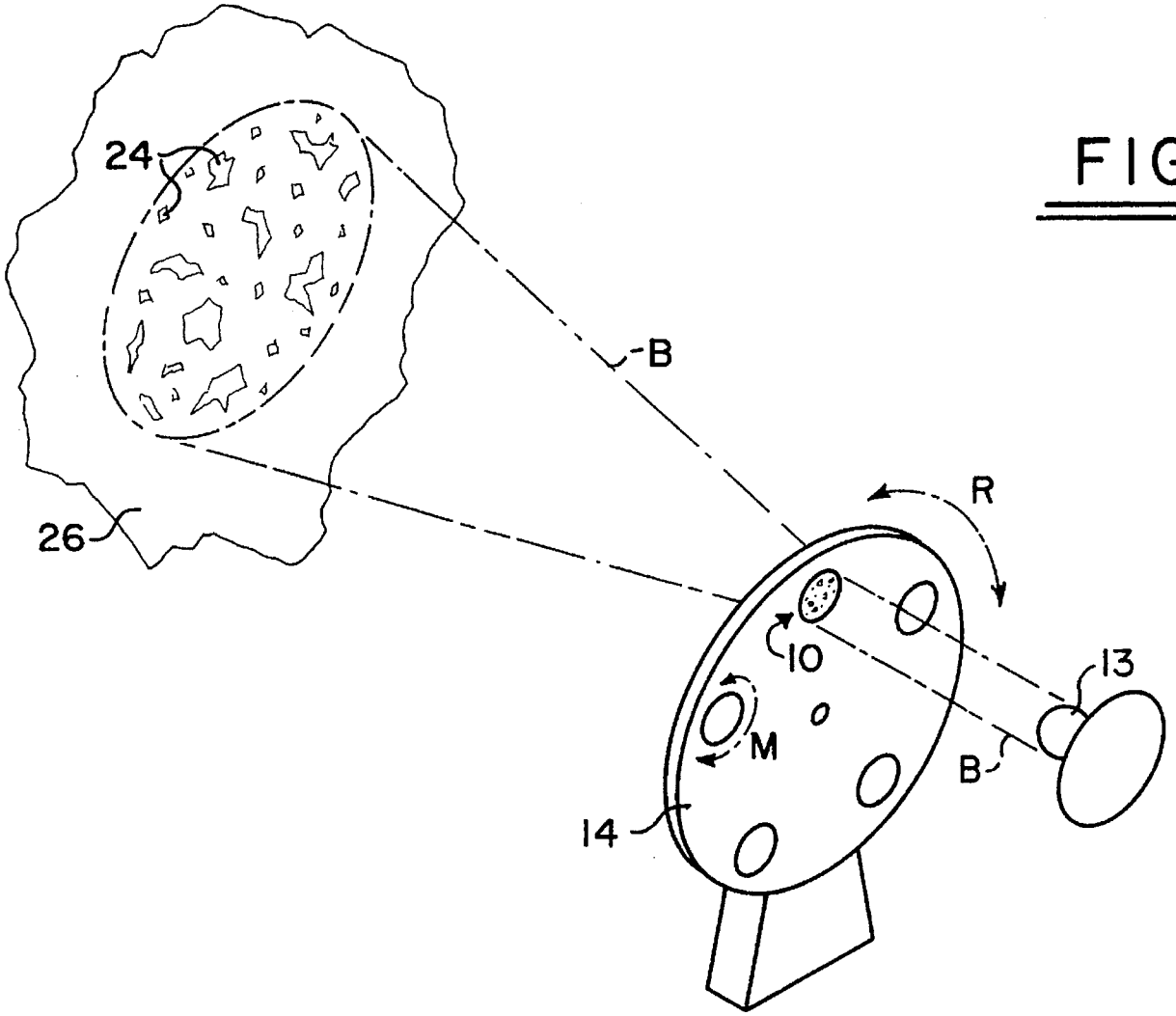
FIG. 2 is a schematic view illustrating a gobo movably mounted in a projected light path.

FIGS. 1–3 illustrate that a gobo 10 comprises a container 11 having transparent plates or walls 12. Gobo 10 may be movably mounted in a gobo wheel 14, which bi-directionally rotates as indicated by the arrow designated R, so that when gobo 10 is moved into the path of a light beam designated B, generated from a light source 13, the selected gobo image is in position to be projected by the light. Present gobos 10 also bi-directionally rotate as indicted by the arrow designated M, independent of the wheel 14, once the gobo 10 is positioned in the beam B.

A fluid cavity 16 is defined within the container 11. An optically clear fluid 18, preferably 510 silicone fluid manufactured by Dow Corning, is in the cavity 16 and a plurality of various color producing shaped solid translucent particles 20, 22 are suspended for random movement in fluid 18. Particles 20, 22 are preferably dichroic filters. Thus, when the beam B is passed through transparent plates 12 of container 11, various moving color producing images 24 are projected by the beam B onto a projection surface 26, which may be a solid surface or theatrical fog, in response to the particles 20, 22 interfering with, but not blocking passage of the beam B through container 11.

FIGS. 1 and 3 illustrate features of gobo 10 more particularly. Generally, gobo 10 comprises a pair of transparent circular plates 12, preferably formed of quartz, which are maintained in spaced relationship by a primary O-ring seal member 28, preferably formed of a fluoro-carbon elastomer material sold under the name VITON by the Du Pont Company of Wilmington, Dela., thus defining cavity 16. An inner ring 29, formed of polytetrafluoroethylene, is preferably used between seal member 28 and fluid 18 for the purpose of reinforcing seal member 28 and for protecting seal 28 from ultra-violet light which can affect the life of seal 28. The thickness of ring 29 is less than the diameter of seal 28 so as not to interfere with the compression of seal 28 between plates 12.

The particles 20 are preferably particles of dichroic coated glass which are heated in a kiln to a temperature which causes the glass to begin to flow, thus smoothing the sharp edges and distorting the shape somewhat, and particles 22 which are dichroic metal flakes which have been separated from the substrate on which they are deposited. When light is passed through the gobo 10, particles 20, 22 distort the light beam and filter out some colors of the spectrum to create desired colored lighting effects. Distortion of the shape of the glass 20 by heating, also distorts or causes the color image produced by the glass to be non-homogeneous because of the use of a dichroic coating, especially at the edges thereof. As an alternative to dichroic particles, the colored images could also be produced by a plurality of multi-colored immiscible fluids contained in cavity 16.

Container 11 includes receiver ring 30 and cap ring 32, preferably formed of aluminum, which are rotatably engaged. A threaded portion 31 of receiver ring 30 is matingly engaged with a threaded portion 33 of cap ring 32. Receiver ring 30 also includes an annular aperture 34 and an adjacent seat 35 having a groove 37 formed therein for receiving a secondary sealing O-ring 36 also formed of the above-described elastomer and encapsulated in a polytetrafluoroethylene coating 36*a*. In this manner, the life of ring 36 is increased and a beneficial amount of lubricity is provided to aid in the relative rotation of rings 30, 32 during assembly and disassembly.

Cap ring 32 also includes an annular aperture 38 and an adjacent seat 39 having a groove 40 formed therein for receiving another secondary sealing O-ring 41 including a coating file 4 1*a* similar to ring 36 as described above. This further provides the above described lubricity which benefits the relative rotation of rings 30, 32.

In accordance with the structural features of the present invention, cavity 16 is defined by plates 12 and primary seal member 28. Seal member 28 is sandwiched between plates 12. Seal members 36 and 41 enhance the sealing engagement of rings 30, 32 with plates 12 and enhance rotational engagement thereof. Prior to closing of cavity 16, fluid 18 and particles 20, 22 are deposited therein while plates 12 and seal member 28 are submerged in fluid 18 to limit the access of air into cavity 16 duting this operation. Cap ring 32 is then rotatably engaged with receiver ring 30 so as to compress seal 28 between plates 12. A pair of diametrically opposed grooves 42, formed in cap ring 32, engaged by a suitable tool (not shown), facilitate the rotational engagement and disengagement of rings 30, 32.

Gobo 10 can then be placed in a gobo wheel 14 and positioned in light beam B, then rotated in position to provide the desired artistic lighting effect created by the random suspension of particles 20, 22 in fluid 18 within cavity 16.

While this invention has been illustrated and described in accordance with a preferred embodiment, it is recognized that variations and changes may be made therein without departing from the invention as set forth in the claims.

Having described the invention, what is claimed is:

1. A colored light pattern generator comprising:

a pair of transparent plates maintained in spaced relationship in a sealed container, whereby the plates define a cavity therebetween:

the container including a first receiver ring and a second cap ring, the first and second rings being rotatably engaged:

seal means for providing a fluid-tight seal for retaining fluid in the cavity;

means in the cavity for producing colored images in response to a beam of light being passed through the transparent plates;

the plates being circular glass plates;

the plates including a primary compressible seal member therebetween: and one of the plates being separated from the first ring by a secondary seal member and the other of the plates being separated from the second ring by another secondary seal member.

2. A colored light pattern generator as defined in claim 1 wherein the means in the cavity for producing projected colored images includes an optically clear fluid and a plurality of various color producing, shaped solid translucent particles suspended for random movement in the fluid.

3. A colored light pattern generator comprising:

a first ring;

a pair of transparent plates maintained in spaced relationship in the first ring, whereby plates define a cavity therebetween;

a second ring rotatably engaged with the first ring, whereby the rings form a container and the plates are maintained in the container;

means for fluidly sealing the cavity within the container;

the plates including a primary compressible seal member therebetween; and one of the plates being sealed from the first ring by a secondary seal member and the other of the plates being sealed from the second ring by another secondary seal member.

4. The colored light pattern generator as defined in claim 3, and further including:

means in the cavity for producing projected colored images in response to a beam of light being passed through the transparent plates.

5. A colored light pattern generator including a pair of transparent plates maintained in spaced relationship in a sealed container, whereby the plates define a cavity therebetween, the container including a receiver ring and a cap ring rotatably engaged with said receiver ring and means for fluidly sealing said cavity;

means in the cavity for producing fluid suspended colored images in response to a beam of light being passed through the plates, the plates including a primary compressible seal member therebetween; and one of the plates being sealed from the receiver ring by a secondary seal member and the other of the plates being sealed from the cap ring by another secondary seal member.

6. The colored light pattern generator as defined in claim 5 wherein the means for producing fluid suspended colored images includes an optically clear fluid and a plurality of various color producing, shaped solid translucent particles suspended for random movement in the fluid.

7. The colored light pattern generator as defined in claim 5 wherein the receiver ring and cap ring are threaded for mating engagement.

8. A colored light pattern generator image projection system comprising:

a container having transparent walls, the container being movably mounted in the path of a light beam, the container defining a sealed fluid cavity therein, an optically clear fluid in the cavity and a plurality of various color producing, shaped solid translucent particles suspended for random movement in the fluid, the container being formed by a retainer ring rotatably engaged with a cap ring, the transparent walls having a primary compressible seal member therebetween, and the walls being retained by the rings, whereby when the light beam is passed through the container and the container is moved, various moving colored images are projected by the beam onto a projection surface in response to the particles interfering with passage of the beam through the container; and, one of the transparent walls being sealed from the retainer ring by a secondary seal member and the other of the transparent walls being sealed from the cap ring by another secondary seal member.

9. The colored light pattern generator image projection system as defined in claim 8 wherein the solid translucent particles include dichroic material.

* * * * *